US008138850B2

(12) United States Patent
Huang et al.

(10) Patent No.: US 8,138,850 B2
(45) Date of Patent: Mar. 20, 2012

(54) FEEDING APPARATUS FOR A SEMI-CIRCULAR SHAPE WAVEGUIDE WITH FEEDING SEGMENTS OFFSET FROM THE MIDPOINT OF THE SEMI-CIRCULAR WAVEGUIDE

(75) Inventors: Chang-Hsiu Huang, Taipei Hsien (TW); Chieh-Sheng Hsu, Taipei Hsien (TW)

(73) Assignee: Wistron NeWeb Corporation, Hsi-Chih, Taipei Hsien (TW)

( * ) Notice: Subject to any disclaimer, the term of this patent is extended or adjusted under 35 U.S.C. 154(b) by 243 days.

(21) Appl. No.: 12/579,410

(22) Filed: Oct. 15, 2009

(65) Prior Publication Data

US 2010/0117756 A1 May 13, 2010

(30) Foreign Application Priority Data

Nov. 7, 2008 (TW) ..... 97143091 A

(51) Int. Cl.
*H01P 5/107* (2006.01)

(52) U.S. Cl. ..... 333/26; 333/21 A

(58) Field of Classification Search ..... 333/26, 333/34, 21 A
See application file for complete search history.

(56) References Cited

U.S. PATENT DOCUMENTS 5,471,664 A * 11/1995 Kim ..... 455/323
5,724,049 A * 3/1998 Park et al. ..... 343/705
6,426,729 B2 * 7/2002 Yoshida et al. ..... 343/786
6,859,184 B2 * 2/2005 Ohtani et al. ..... 343/756

* cited by examiner

*Primary Examiner* — Benny Lee
(74) *Attorney, Agent, or Firm* — Winston Hsu; Scott Margo

(57) ABSTRACT

A feeding apparatus is utilized for a waveguide. The waveguide includes an opening and a bottom periphery around the opening. The bottom periphery includes a feeding side. The feeding apparatus includes a substrate and a feeding segment. The substrate is connected to the bottom periphery of the waveguide. The feeding segment installed in the substrate is utilized for feeding a signal into the waveguide, which the feeding segment extends to the opening from a position of the feeding side different from midpoint of the feeding side.

10 Claims, 8 Drawing Sheets

FEEDING APPARATUS FOR A SEMI-CIRCULAR SHAPE WAVEGUIDE WITH FEEDING SEGMENTS OFFSET FROM THE MIDPOINT OF THE SEMI-CIRCULAR WAVEGUIDE

BACKGROUND OF THE INVENTION

1. Field of the Invention

The present invention relates to a feeding apparatus for a waveguide and related communication apparatus, and more particularly, to a feeding apparatus for a waveguide and related communication apparatus capable of reducing layout area of a printed circuit board.

2. Description of the Prior Art

With rapidly growing wireless communication technology, a wireless communication device should be of small size and light weight. In a wireless front-end module, a waveguide is often used as a transition line in microwave and millimeter circuitry due to its low-loss transmission.

Please refer to FIG. 1. FIG. 1 is a schematic diagram of transition from a microstrip line to a waveguide in the prior art. Axes X, Y and Z indicate three orthogonal coordinate axes. As shown in FIG. 1, a waveguide 102 is semicircle shaped. In general, a microstrip line printed circuit board 104 extends to the waveguide 102 perpendicular to a diametric side of the waveguide 102 by using a microstrip line probe 106 in order to feed a signal. Please refer to FIG. 2. FIG. 2 is a top-view diagram of a layout of the microstrip line printed circuit board 104 in the prior art. In the prior art, transition from the microstrip line to the waveguide is designed symmetrically, and the microstrip line probe 106 extends to the semicircle region in a perpendicular direction. Therefore, the microstrip line printed circuit board 104 has a large transverse area, i.e. in a first direction 100. However, as shown in FIG. 2, a microwave circuit 202 coupled to the microstrip line probe 106 does not need such a large layout area in practice. But, due to the feeding approach, the microstrip line printed circuit board 104 must have the large transverse area, which generates a large, unused blank region 204. In other words, distribution of the layout of the microwave circuit 202 is sparse, wasting printed circuit board area and increasing manufacturing cost.

SUMMARY OF THE INVENTION

It is therefore one of the objectives of the present invention to provide a feeding apparatus for a waveguide and related communication apparatus.

According to an embodiment of the invention, a feeding apparatus for a waveguide is disclosed. The waveguide includes an opening and a bottom periphery around the opening. The bottom periphery includes a feeding side. The feeding apparatus includes a substrate and a feeding segment. The substrate is connected to the bottom periphery of the waveguide. The feeding segment installed in the substrate is utilized for feeding a signal into the waveguide, which the feeding segment extends to the opening from a position of the feeding side different from midpoint of the feeding side.

According to an embodiment of the invention, a communication apparatus for a waveguide is disclosed. The communication apparatus includes a waveguide, a feeding apparatus, and a carrier. The waveguide includes an opening and a bottom periphery around the opening. The bottom periphery includes a feeding side. The feeding apparatus includes a substrate and a feeding segment. The substrate is connected to the bottom periphery of the waveguide. The feeding segment installed in the substrate is utilized for feeding a signal into the waveguide, which the feeding segment extends to the opening from a position of the feeding side different from midpoint of the feeding side. The carrier having a containing space formed on the communication apparatus is utilized for holding the feeding apparatus and coupled to the waveguide.

These and other objectives of the present invention will no doubt become obvious to those of ordinary skill in the art after reading the following detailed description of the preferred embodiment that is illustrated in the various figures and drawings.

DETAILED DESCRIPTION OF THE INVENTION

Figure 3:
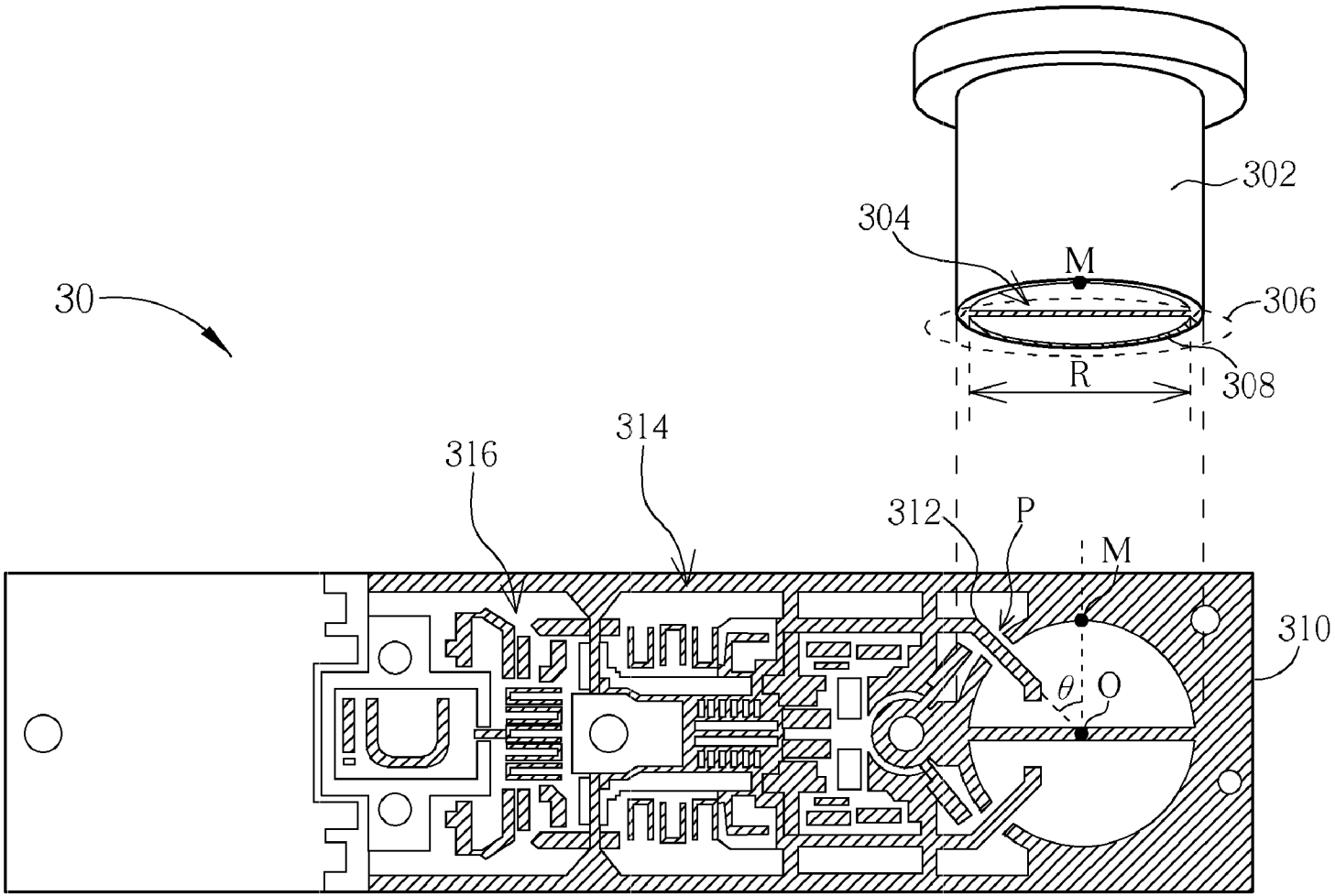
FIG. 3 is a schematic diagram of a feeding apparatus according to an embodiment of the invention.

Please refer to FIG. 3. FIG. 3 is a schematic diagram of a feeding apparatus 30 according to an embodiment of the invention. The feeding apparatus 30 is utilized for a waveguide 302 which includes an opening 304 and a bottom periphery 306 around the opening 304. The bottom periphery 306 includes a feeding side 308. Preferably, the waveguide 302 is semicircle shaped, the bottom periphery 306 is semicircle ring shaped, and the feeding side 308 is semicircle arc shaped. The feeding apparatus 30 includes a substrate 310, and a feeding segment 312. The substrate 310 is connected to the bottom periphery 306 of the waveguide 302. The feeding segment 312 is installed in the substrate 310 and coupled to a radio frequency circuit 314 for feeding a signal into waveguide 302. The feeding segment 312 extends to the opening 304 from a position P of the feeding side 308 different from midpoint M of the feeding side 308. In other words, an angle θ between a feeding direction of the feeding segment 312 and the normal direction of a diametric side R is formed, i.e. the angle θ between a line crossing the position P and the center O of the bottom periphery 306 and a line crossing the midpoint M of the feeding side 308 and the center O of the bottom periphery 306. Preferably, the angle θ is less than 60 degrees. Preferably, the angle θ is 50 degrees. Therefore, the feeding apparatus 30 extends to the opening 304 in the direction non-perpendicular to the diametric side R of the bottom periphery 306 through the feeding segment 312 and feeds a signal of the radio frequency circuit 314 into the waveguide 302, to reduce area of a blank region 316 shown in the FIG. 3.

Figure 1:
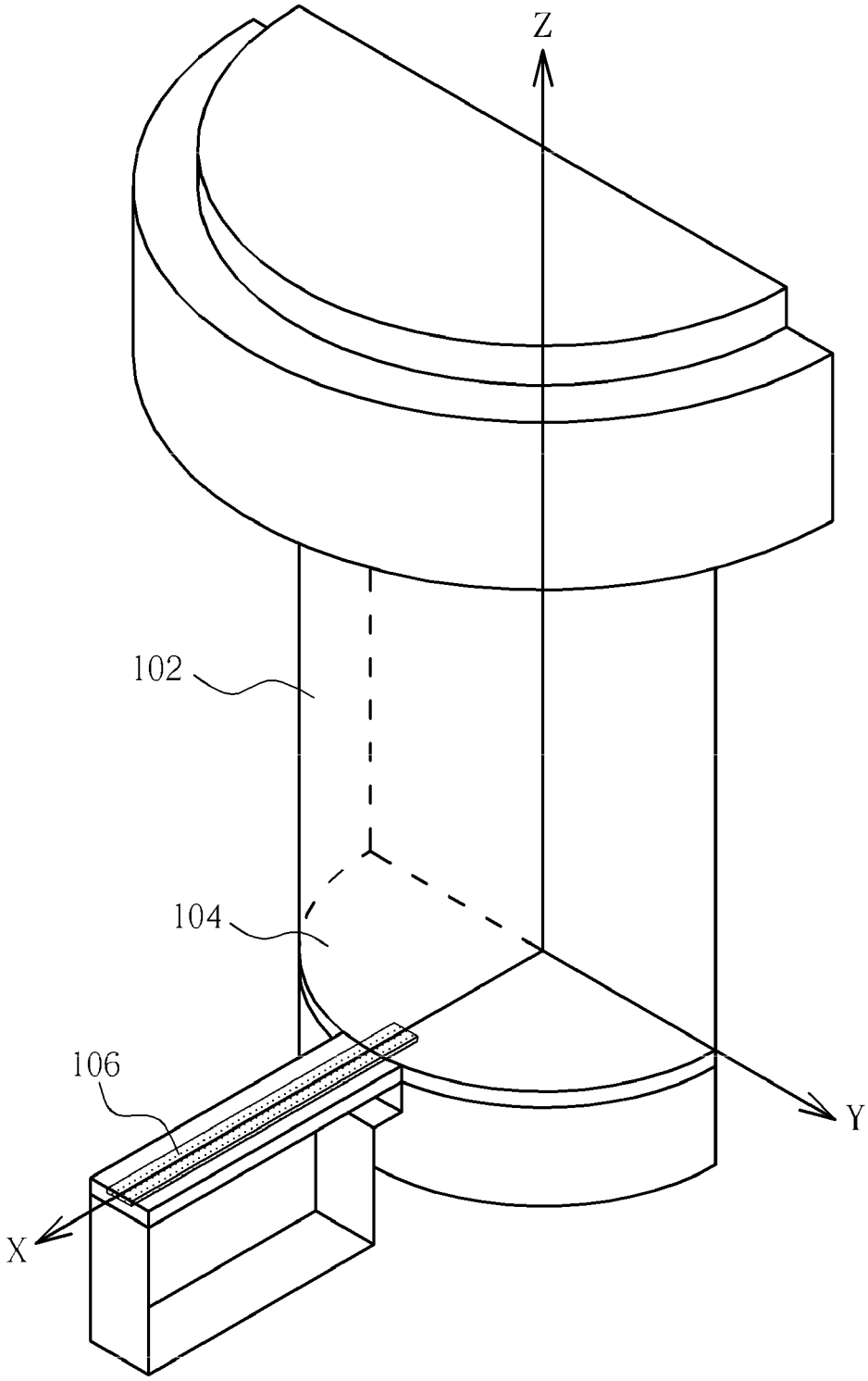
FIG. 1 PRIOR ART
FIG. 1 is a schematic diagram of transition from a microstrip line to waveguide in the prior art.
Figure 2:
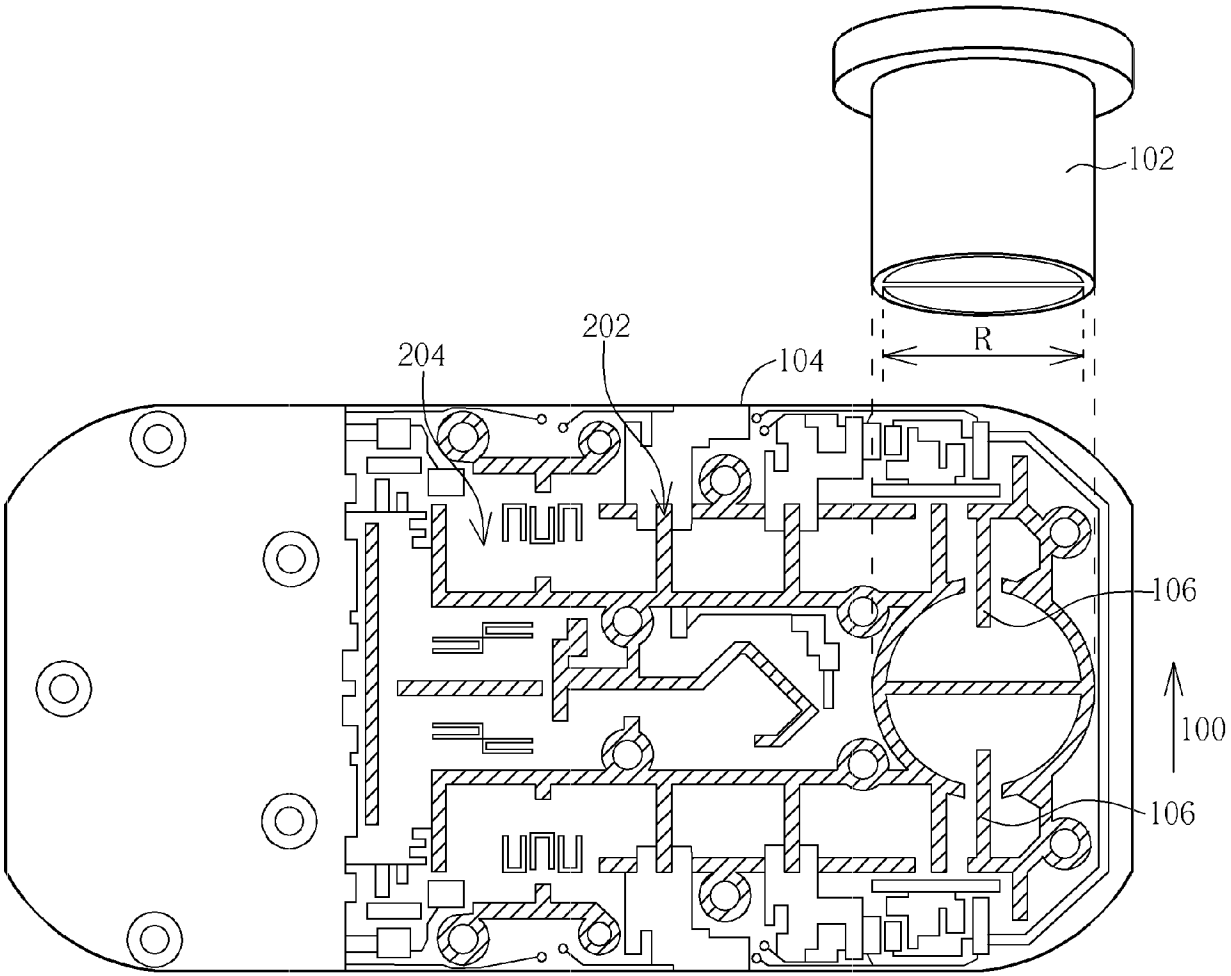
FIG. 2 PRIOR ART
FIG. 2 is a top-view diagram of a layout of the microstrip line printed circuit board in the prior art.
Figure 4:
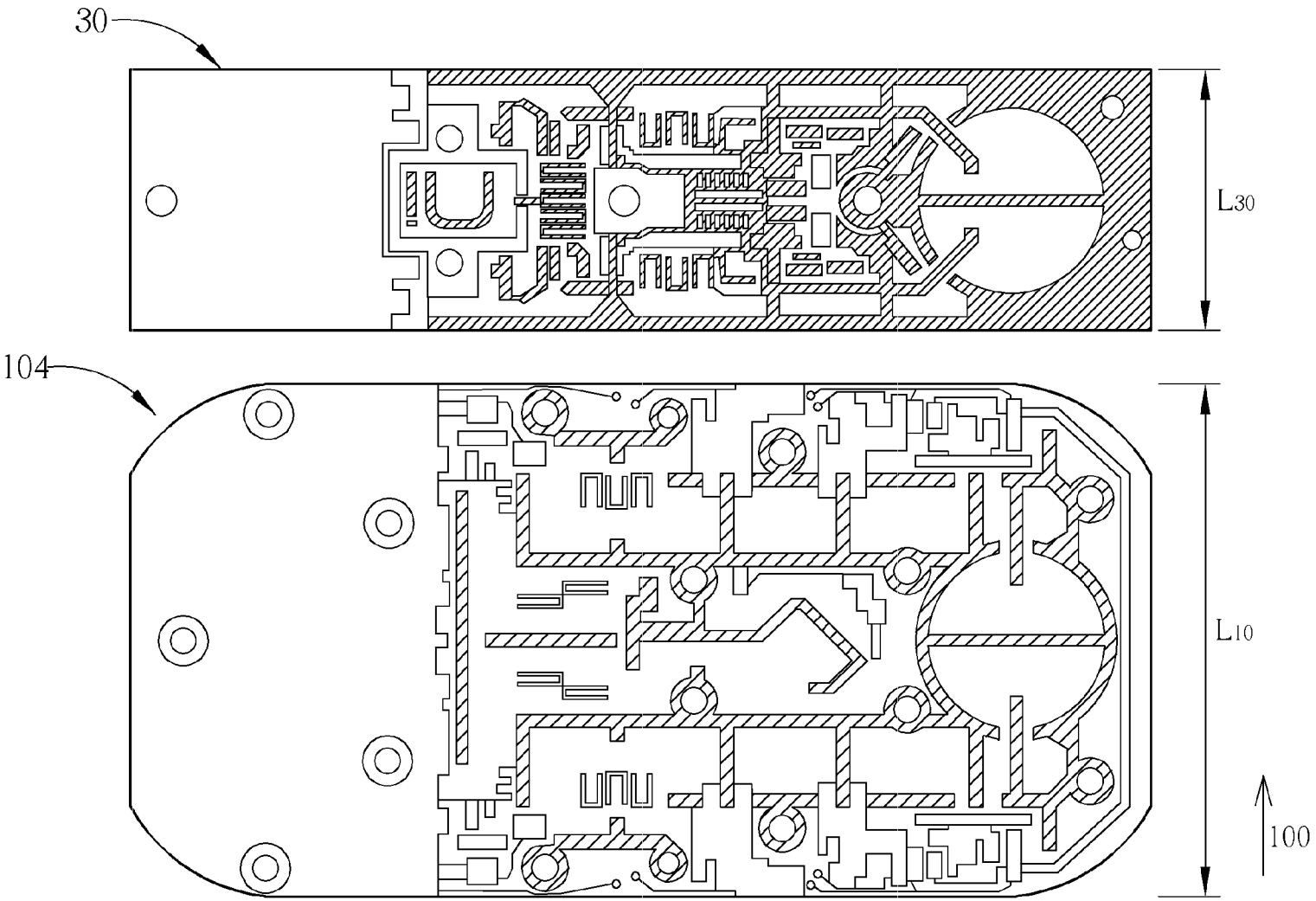
FIG. 4 is a comparative diagram comparing a feeding apparatus in the prior art and the invention.

Furthermore, please refer to FIG. 4. FIG. 4 is a comparative diagram comparing a feeding apparatus in the prior art as depicted in FIG. 2 and the invention as depicted in FIG. 3. The feeding apparatus 30 has the same circuit devices as the microstrip line printed circuit board 104. In the prior art, the microstrip line probe 106 extends to the opening of the waveguide 102 in a direction perpendicular to the diametric side R. Compared with the prior art, in the invention as depicted in FIG. 3, the feeding segment 312 extends to the opening 304 from a position P of the feeding side 308 as depicted in FIG. 3, which the position P is different from midpoint M of the feeding side 308 as depicted in FIG. 3. Therefore, as shown in FIG. 4, a transverse length L30 of the substrate 310 is far less than a transverse length L10 of the microstrip line printed circuit board 104 in a first direction 100. As a result, through the structural design of the feeding segment 312, the invention can enhance density of the radio frequency circuit, reduce circuit layout area of the printed circuit board, and use fewer screws, for reducing product volume, product weight, and manufacturing cost.

Figure 5:
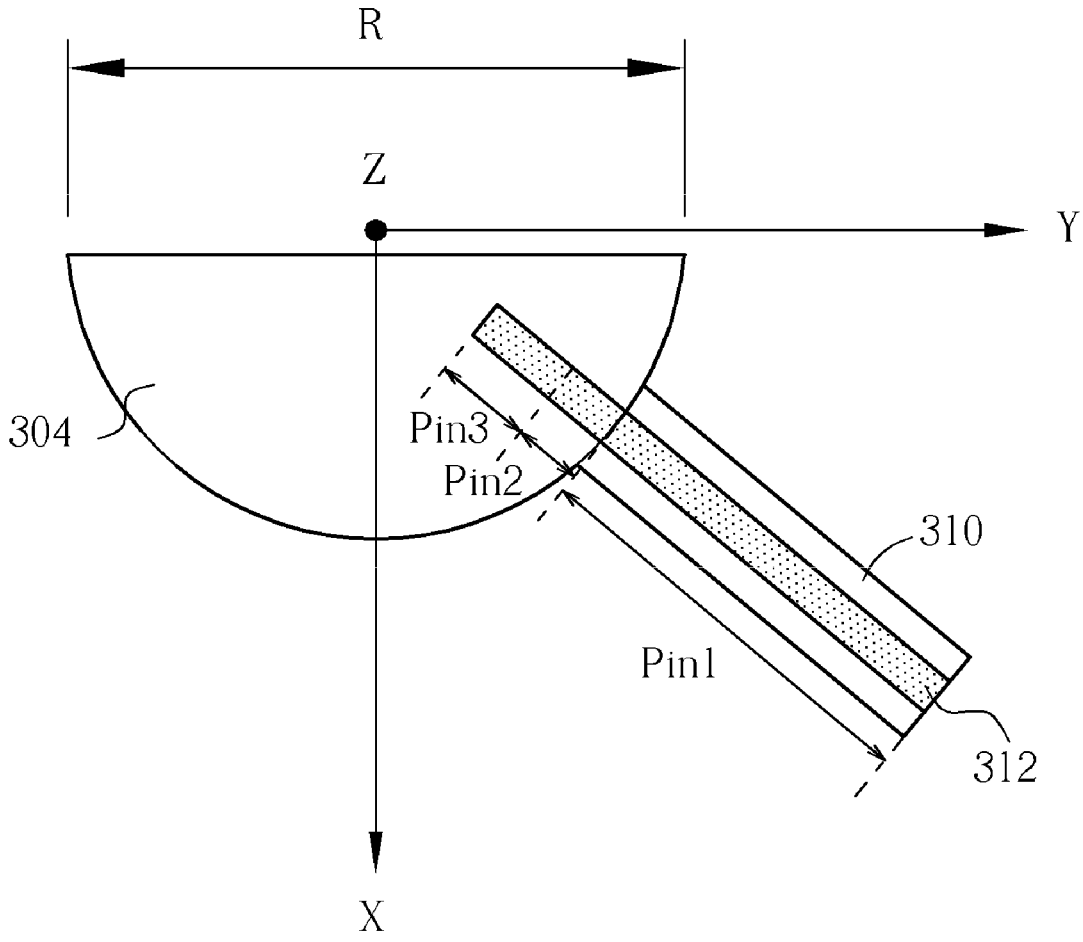
FIG. 5 to FIG. 7 are top-view diagrams of the feeding apparatus for the waveguide according to an embodiment of the invention.
Figure 6:
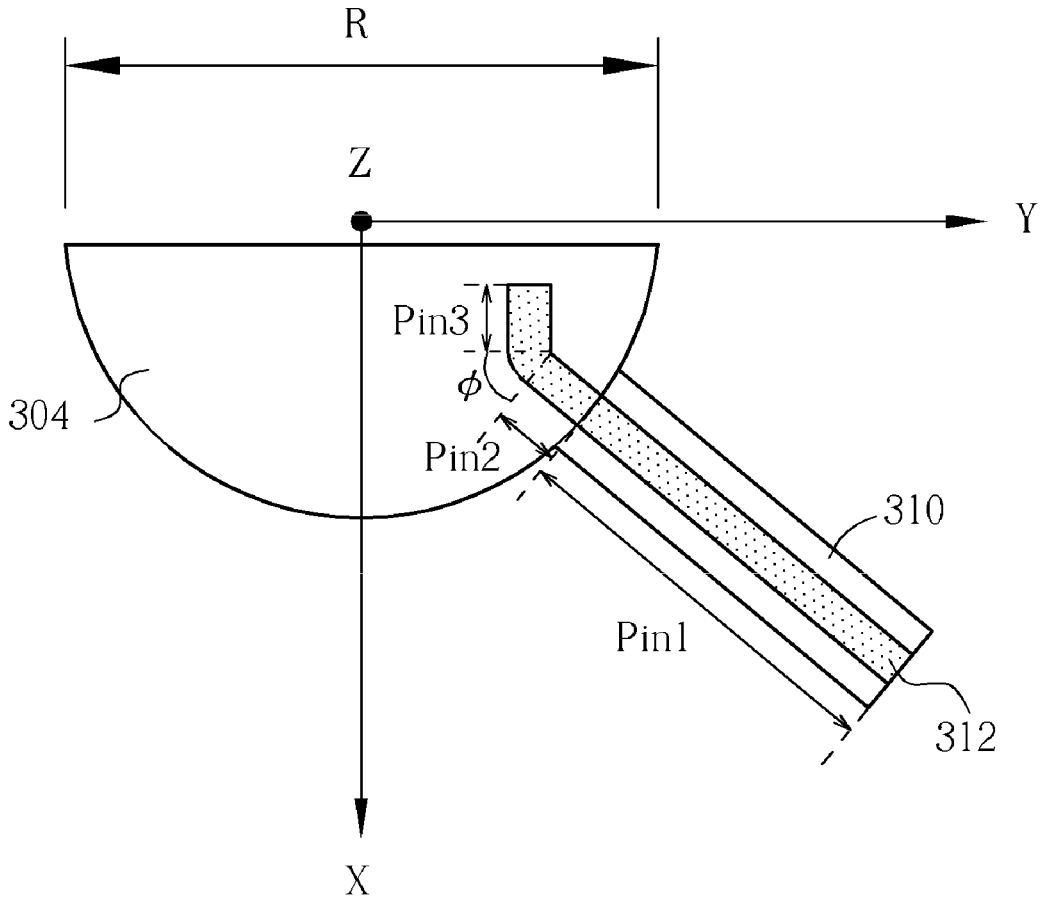
Figure 7:
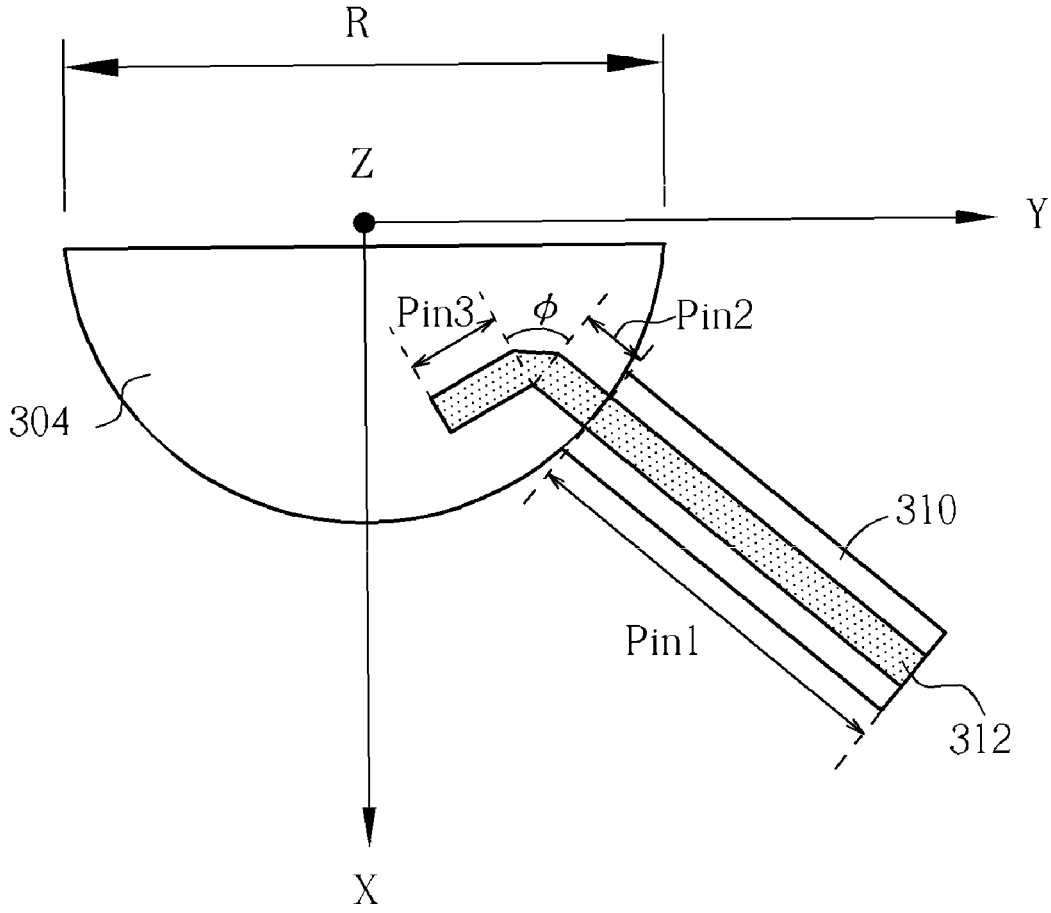
Figure 8:
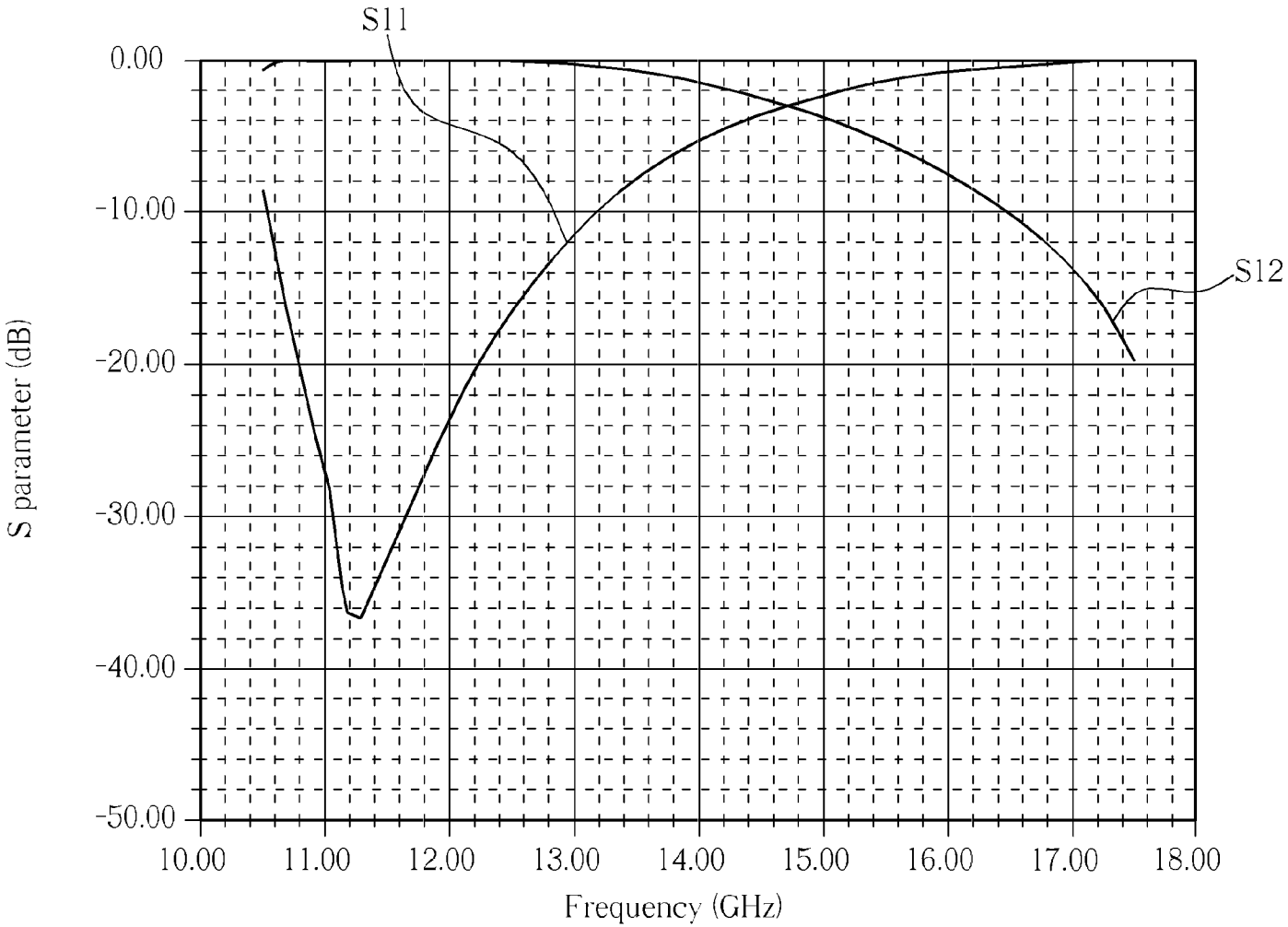
FIG. 8 is a simulation diagram illustrating transition characteristic of a microstrip line to waveguide according to an embodiment of the invention.

In addition, please refer to FIG. 5-FIG. 7. FIG. 5-FIG. 7 are top-view diagrams of the feeding apparatus 30 for the waveguide 302 according to an embodiment of the invention as depicted in FIG. 3, and thus the details are omitted herein for the sake of brevity. Axes X, Y and Z indicate three orthogonal coordinate axes. The feeding segment 312 further includes a first segment Pin1 located outside the opening 304, a second segment Pin2 located inside the opening 304 and connected to the first segment Pin1, and a third segment Pin3 inside the opening 304 and connected to the second segment Pin2. Preferably, the first segment Pin1 and the second segment Pin2 are connected in a straight line and orthogonal to the feeding side 308, as depicted in FIG. 3. As shown in FIG. 5, R indicates a diametric side of the bottom periphery 306. The connected first segment Pin1, second segment Pin2, and third segment Pin3 can be arranged in a straight line. As shown in FIG. 6, the third segment Pin3 can be bent to extend to the diametric side R with a bend angle ψ. In FIG. 7, the third segment Pin3 can be bent away from the diametric side R with a bend angle ψ. As a result, the invention can change the feeding direction of the feeding segment 312 to reduce transverse area of the feeding apparatus 30, and vary the third segment Pin3 of the feeding segment 312 to achieve better electric characteristics. Generally speaking, from the standpoint of electric characteristic standard requirements, not only should transition energy of the microstrip line to the waveguide be sufficiently high, but transmission bandwidth should also be as wide as possible. For example, the transition bandwidth should be wider than 1 GHz. Thus, please refer to FIG. 8. FIG. 8 is a simulation diagram illustrating a transition characteristic of a microstrip line to a waveguide according to an embodiment of the invention. The horizontal axis represents operating frequency (in GHz), and the vertical axis represents the gain of S parameters (in dB). In FIG. 8, simulation results for S11 parameter and S12 parameter are shown for the angle θ between a line crossing the position P and the center O of the bottom periphery 306 and a line crossing the midpoint M of the feeding side 308 and the center O of the bottom periphery 306 being 50 degrees and the third segment Pin3 being bent to extend to the diametric side R at 58.4 degrees, i.e. the angle ψ is 58.4 degrees, performed using Ansoft's High Frequency Structure Simulator (HFSS). As shown in FIG. 8, the transition bandwidth can achieve 1.5 GHz, which is sufficient for the electrical standard.

Please note that the feeding apparatus 30 is an exemplary embodiment of the invention, and those skilled in the art can make alternations and modifications accordingly. For example, any kind or material of substrate having a pattern layout can be used as the substrate 310 as depicted in FIGS. 3, 5, 6 and 7. In addition, the feeding segment 312 may be any type capable of transmitting radio frequency signals with a microstrip line probe. The radio frequency circuit 314 coupled to the feeding segment 312, as depicted in FIG. 3, may be a low noise amplifier, an intermediate frequency (IF) filter, an IF amplifier, other radio frequency circuit, or any combination thereof. Preferably, the radio frequency circuit 314 is symmetrical to the diametric side R on the substrate 310. Moreover, in the embodiment of the invention, exterior of each apparatus can be covered with metal. On the other hand, the feeding apparatus 30 can be applied in any communication apparatus which has a containing space for holding the feeding apparatus 30 and is coupled to the waveguide 302, and those skilled in the art can make alternations and modifications accordingly.

In summary, the invention can reduce the transverse area of the feeding apparatus, so as to enhance density of the radio frequency circuit, and reduce circuit layout area of the printed circuit board and amount of screws. Thus, the invention can reduce product volume, product weight, and manufacturing cost. Moreover, the invention can vary the feeding direction for achieving the electrical specification efficiently.

Those skilled in the art will readily observe that numerous modifications and alterations of the device and method may be made while retaining the teachings of the invention.

What is claimed is:

1. A feeding apparatus for a waveguide, the waveguide comprising an opening and a bottom periphery around the opening, the bottom periphery comprising a feeding side and a diametric side, wherein the waveguide is semicircle shaped, the bottom periphery is semicircle ring shaped, and the feeding side is semicircle arc shaped, the feeding apparatus comprising:

a substrate connected to the bottom periphery of the waveguide; and a feeding segment installed in the substrate for feeding a signal into the waveguide and extending to the opening from a position of the feeding side different from midpoint of the feeding side, comprising:

a first segment located outside the opening;

a second segment located inside the opening and connected with the first segment; and a third segment inside the opening and connected with the second segment, wherein the third segment is bent to extend to the diametric side.

2. The feeding apparatus of claim 1, wherein the feeding segment is coupled to a radio frequency circuit.

3. The feeding apparatus of claim 1, wherein angle between a feeding direction of the feeding segment and a normal direction of the diametric side is less than 60 degrees.

4. The feeding apparatus of claim 1, wherein angle between a feeding direction of the feeding segment and a normal direction of the diametric side is 50 degrees.

5. The feeding apparatus of claim 1, wherein the first segment and the second segment are connected in a straight line, and both of the first segment and the second segment are orthogonal to the feeding side.

6. A communication apparatus comprising:

a waveguide comprising an opening and a bottom periphery around the opening, wherein the bottom periphery comprises a feeding side and a diametric side and the waveguide is semicircle shaped, the bottom periphery is semicircle ring shaped, and the feeding side is semicircle arc shaped;

a feeding apparatus comprising:

a substrate connected to the bottom periphery of the waveguide; and a feeding segment installed in the substrate for feeding signal into the waveguide and extending to the opening from a position of the feeding side different from midpoint of the feeding side, comprising:

a first segment located outside the opening;

a second segment located inside the opening and connected with the first segment; and a third segment inside the opening and connected with the second segment, wherein the third segment is bent to extend to the diametric side; and a carrier having a containing space formed on the communication apparatus for holding the feeding apparatus, and coupled to the waveguide.

7. The communication apparatus of claim 6, wherein the feeding segment is coupled to a radio frequency circuit.

8. The communication apparatus of claim 6, wherein the first segment and the second segment are connected in a straight line, and both of the first segment and the second segment are orthogonal to the feeding side.

9. The communication apparatus of claim 6, wherein angle between a feeding direction of the feeding segment and a normal direction of the diametric side is 50 degrees.

10. The communication apparatus of claim 6, wherein the angle between a feeding direction of the feeding segment and a normal direction of the diametric side is less than 60 degrees.

* * * * *